US005794636A

United States Patent [19]

Vogel

[11] Patent Number: 5,794,636

[45] Date of Patent: Aug. 18, 1998

[54] ARCHIVAL WASHER FOR PHOTOGRAPHIC PRINTS OR FILM WITH MULTI LEVEL DIVIDERS

[76] Inventor: Daniel A. Vogel, 9171 Bataan St. NE., Blaine, Minn. 55449

[21] Appl. No.: 678,665

[22] Filed: Jul. 11, 1996

[51] Int. Cl.[6] ..... B08B 3/04

[52] U.S. Cl. ..... 134/115 R; 134/183

[58] Field of Search ..... 134/85, 88, 92, 134/115 R, 154, 155, 182, 183, 186; 396/628, 631, 642, 644; 211/41

[56] References Cited

U.S. PATENT DOCUMENTS

| | | | |
|---|---|---|---|
| 243,588 | 6/1881 | Luckett | 134/85 |
| 276,875 | 5/1883 | Price | 134/183 X |
| 323,721 | 8/1885 | Oliver | 396/628 |
| 425,420 | 4/1890 | Gillis | 396/642 X |
| 491,619 | 2/1893 | Ward | 396/642 X |
| 620,565 | 3/1899 | Burke et al. | 134/155 |
| 661,819 | 11/1900 | Saloman | 396/628 X |
| 888,855 | 5/1908 | Sisco | 211/41 X |
| 970,491 | 9/1910 | Grandperrin | 211/41 |
| 4,268,156 | 5/1981 | Kostiner | 396/631 |

*Primary Examiner*—Philip R. Coe

[57] ABSTRACT

A watertight enclosure for washing photographic material. The enclosure has individual print chambers (24), that are separated by dividers (8), (10). The dividers (8), (10), are sectioned into levels with each level having slots (22), (23) at predetermined intervals along the length of each divider that accept rods (9), (11) to hold the material being washed at the top of the washer. The rods (9), (10) also suspend the material in the water at all levels. The washers inlet chamber (2) is suspended above the bottom of the washer so that water and residual chemical can pass under and away from the print chambers (24) as it exits the washer.

18 Claims, 7 Drawing Sheets

ARCHIVAL WASHER FOR PHOTOGRAPHIC PRINTS OR FILM WITH MULTI LEVEL DIVIDERS

BACKGROUND FIELD OF INVENTION

This invention is for washing photographic prints and film to remove chemicals left from the processing stage of film or print development.

BACKGROUND-DESCRIPTION OF PRIOR ART

Processing of film or print material leaves residual chemical on or imbedded in the material. It is necessary to wash this chemical from the print or film if it is to maintain a stable, high quality appearance over a long period of time.

To achieve complete removal of residual chemical from the prints or film being washed, while using the least amount of water, it is necessary to have an even and unimpeded flow of water across all surfaces of the print. Designs of other vertical washers leave the print positioned where the corners of the print are in the corners of the washer. With this design the corners of the print will take longer to wash because water does not flow well to a square corner.

The chemicals being washed from prints or film are heavier than water, and therefore sink to the bottom of the washer before being sufficiently diluted to be carried out with the water. Washer designs that have flat solid bottoms significantly slow the movement of the heavier chemical down and past the print. The chemical will accumulate in higher concentrations along the bottom of the washer before being pushed off to the side or edge of the washer toward an outlet.

Some film formats are rolled onto reels for processing. Washers designed with fixed height dividers do not allow for washing film on reels without removing the dividers completely and washing the reels on the bottom of the washer or having to use an additional attachment for the washer. This is inconvenient and expensive for the user.

Washers with fixed level dividers do not provide a method of washing more than one small print in the same chamber, that is the space between two dividers, without having the prints drift together. If two smaller prints in one print chamber drift together, the prints can stick together, slowing wash time and using more water.

The chemical being washed from film and paper is heavier than water. Washer designs that do not have water exiting from under and outside the print chambers will take longer to wash prints and use more water.

Photographic film and paper comes in many sizes. A washer must be big enough to accommodate the largest size print the user anticipates making. This leaves the user with a relatively large washer for washing the smallest size print or film format as well as the largest. When washing a small print in a big washer, the print will sink to the bottom of the washer making it very difficult to retrieve. Some designs offer a wand to help retrieve the print from the bottom of the washer. This is very inconvenient and makes it easy to damage the print or film while trying to retrieve it.

OBJECTS AND ADVANTAGES

Several objects and advantages of this invention are:

(a) to completely eliminate corners near print edges so that water is free flowing over the entire print surface, decreasing wash time and water used.

(b) to eliminate a flat solid bottom, allowing the heavy chemicals to fall freely past and away from the bottom of the print, therefore decreasing wash time and water used.

(c) to provide a way of washing small print or film formats in large format washers without having to retrieve them off the bottom of the washer.

(d) to provide a method of washing large prints with small prints or film on reels at the same time without the need for additional attachments or baskets.

(e) to provide a method of washing more than one small print in a single print chamber, that is the space between two dividers, without having them drift together, creating the possibility of sticking together.

(f) to provide a method of having water and chemical exit the washer under and away from the print chamber.

DRAWING FIGURES

REFERENCE NUMERALS IN DRAWINGS

Figure 1:
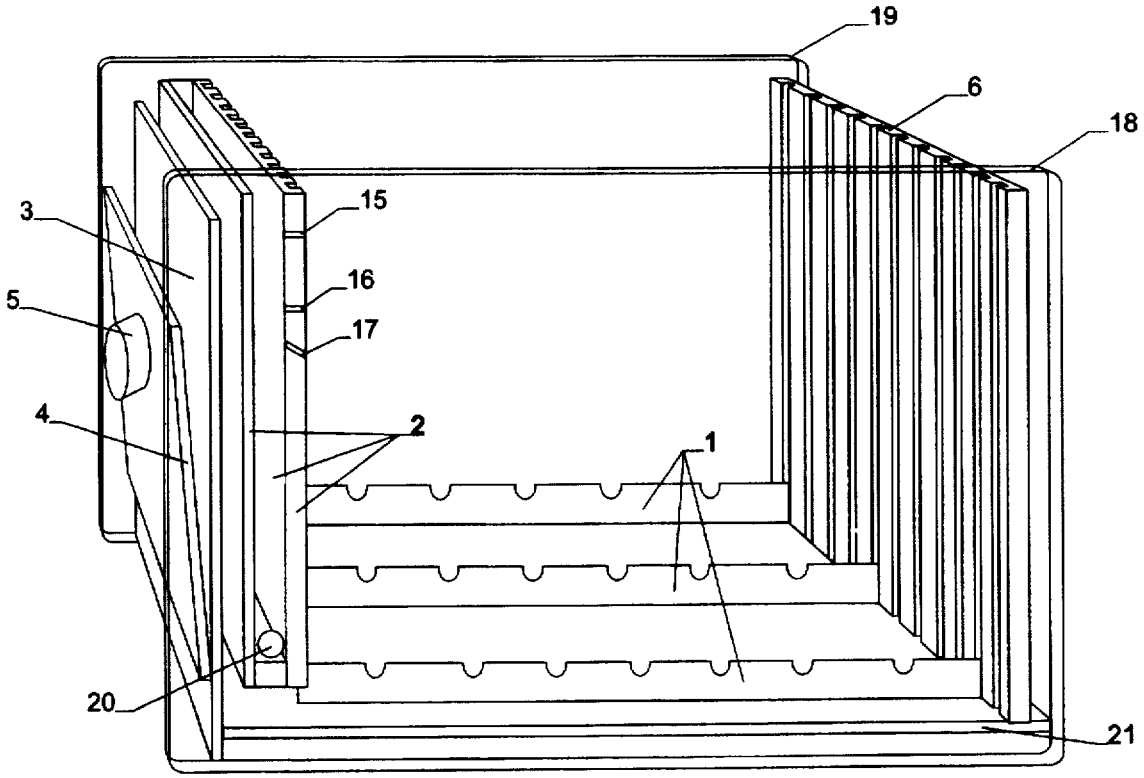
FIG. 1 shows the washer without removable dividers

1 bottom rod holders.
2 inlet manifold
3 overflow panel
4 discharge catch panel
5 fixture for discharge catch panel
6 single grooved end
7 top hold down rods
8 top slotted dividers
9 center optional rods
10 lower slotted dividers
11 bottom rods
12 small material to be washed
13 film on reels to be washed
14 large material to be washed
15 top hole in inlet chamber
16 middle hole in inlet chamber
17 bottom angled holes in inlet chamber
18 side of washer
19 side of washer
20 hole in side of washer for incoming water
21 bottom of washer
22 deep slot in top slotted divider
23 shallow slot in top slotted divider
24 print chamber
25 divider slot
26 drift rods

DESCRIPTION —FIGS. 1–7

FIG. 1 shows the washer without the removable dividers. The preferred material used in constructing the washer is acrylic because it is strong, easily machined, and can be joined with solvent to achieve strong, water tight joints. Any material that can be made to hold water could be used to construct the washer. The washer body consists of a single slotted end 6, attached to two sides 18 and 19 and a bottom 21. The other end of the washer is also slotted and is permanently attached to three other pieces to form an enclosure within the washer for incoming water; this enclosure is called the inlet manifold, FIG. 1, 2. The inlet manifold is attached to both sides 18 and 19 and is positioned 1 inch above the bottom 21.

Figure 3:
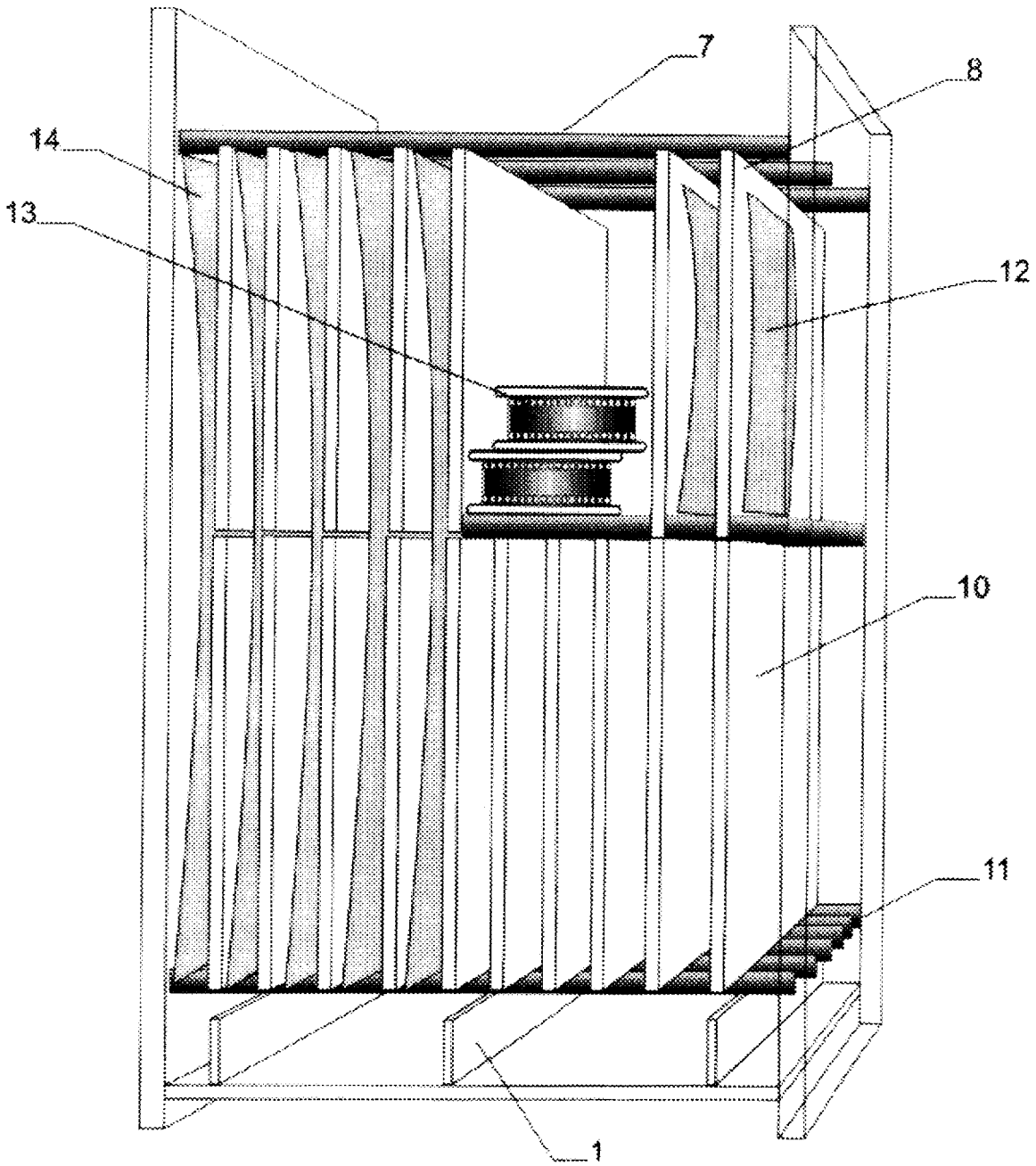
FIG. 3 shows the washer drawn without the end so the organization of internal parts and their effect on material being washed is more easily seen.
Figure 4:
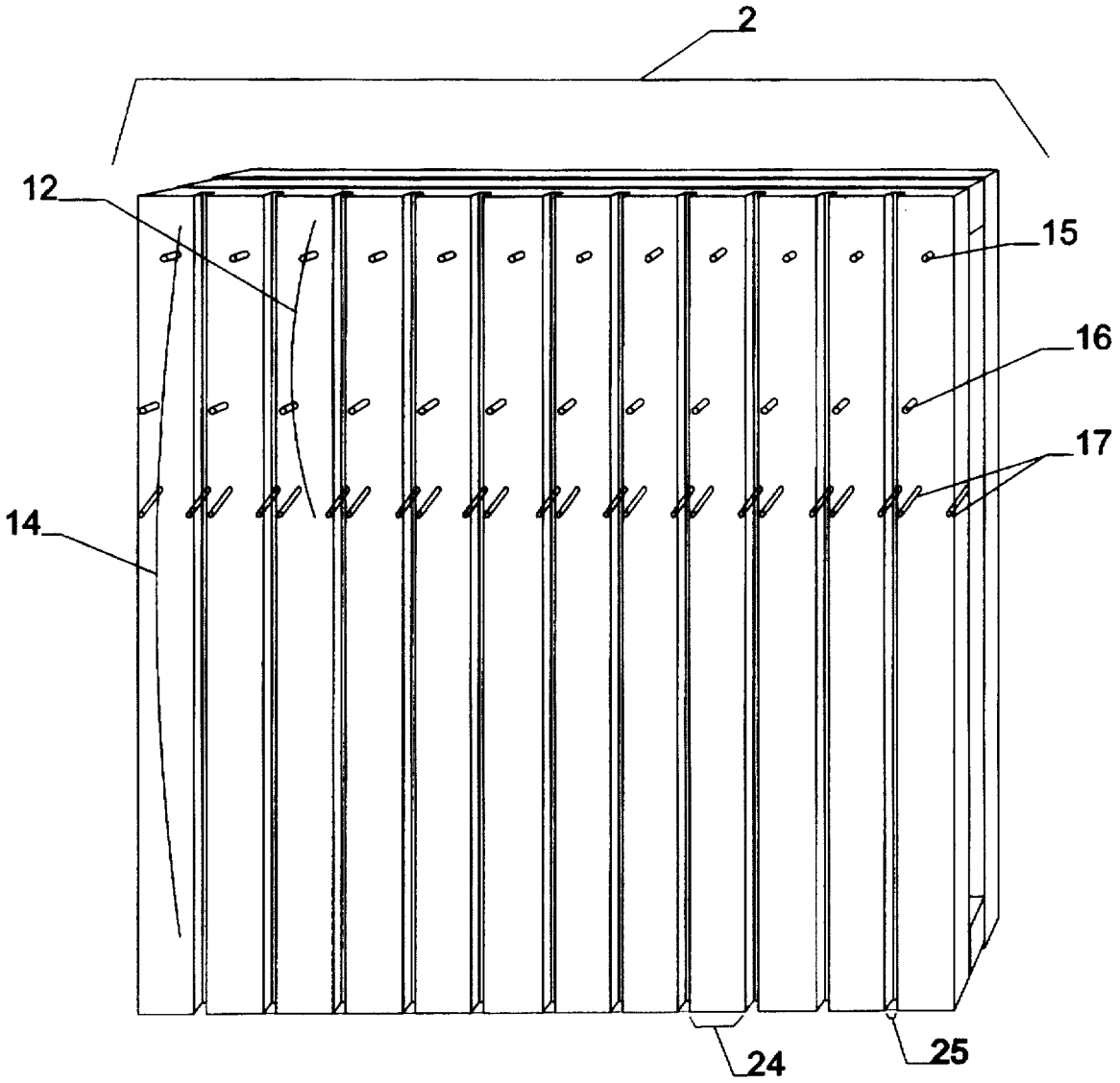
FIG. 4 shows a detail of the water inlet manifold and the positioning of holes in the manifold.

Both ends of the washer have slots, FIG. 4, 25 of ⅛th inch wide by ¼ inch deep running the full vertical dimension. These ⅛ inch slots, FIG. 4, 25 are centered on ¾ inch intervals from one side of each end piece to the other. These slots, FIG. 4, 25 receive dividers FIG. 2, 8 and 10. The material to be washed is placed in a print chamber, FIG. 3. The print chamber is the vertical space between two dividers, FIG. 2, 8 and 10.

The overflow panel FIG. 1, 3 is positioned toward the outside of the washer on the inlet manifold 2, end of the washer. The overflow panel 3, is attached to both sides 18 and 19, and the bottom 21 of the washer. The overflow panel 3 is a length that is shorter than the single slotted end 6 and the inlet manifold 2, and tall enough to maintain a sufficient water level inside the washer when the water is turned off.

The discharge catch panel 4 is attached to both sides 18 and 19 of the washer, and is slanted forward so that the bottom of the discharge catch panel 4 can be attached directly to the overflow panel 3, while maintaining an opening at the top to catch water from the overflow panel 3.

A hole is drilled in the discharge catch panel 4, and a fixture 5, is attached to the discharge catch panel 4. A hose (not shown) is attached to the fixture 5, for carrying away water being discharged from the washer to a sink or drain.

Bottom rod holders 1 are attached to the bottom of the washer. The bottom rod holders receive acrylic rod FIG. 2, 11 that keep the material being washed suspended above the flat bottom of the washer.

Figure 2:
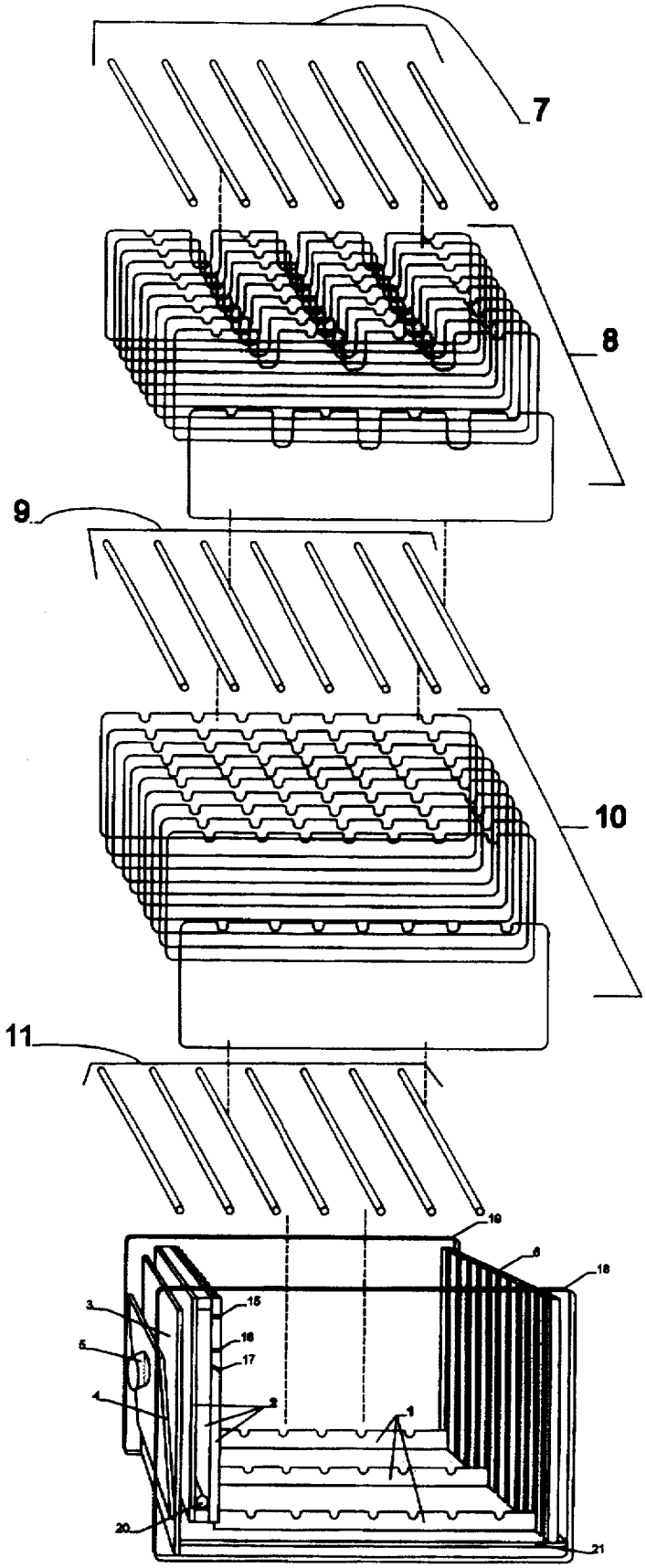
FIG. 2 shows all components of the washer in an exploded view.

FIG. 2 shows all components of the washer suspended above the washer in the order they would be placed into the washer. A set of round rods 11 are placed in the receiving slots of the bottom rod holders 1.

Bottom dividers 10 are placed in each of the slots FIG. 4, 25 in both the single slotted end 6, and the inlet chamber 2. The bottom dividers 10 are inserted all the way down so they rest on the bottom rods 11.

A second set of center optional rods 9 would be placed on top of the bottom dividers if small format paper or film is to be washed.

Top dividers 8 are placed in each of the slots FIG. 4, 25 in both the single slotted end 6 and the inlet manifold 2.

Figure 6:
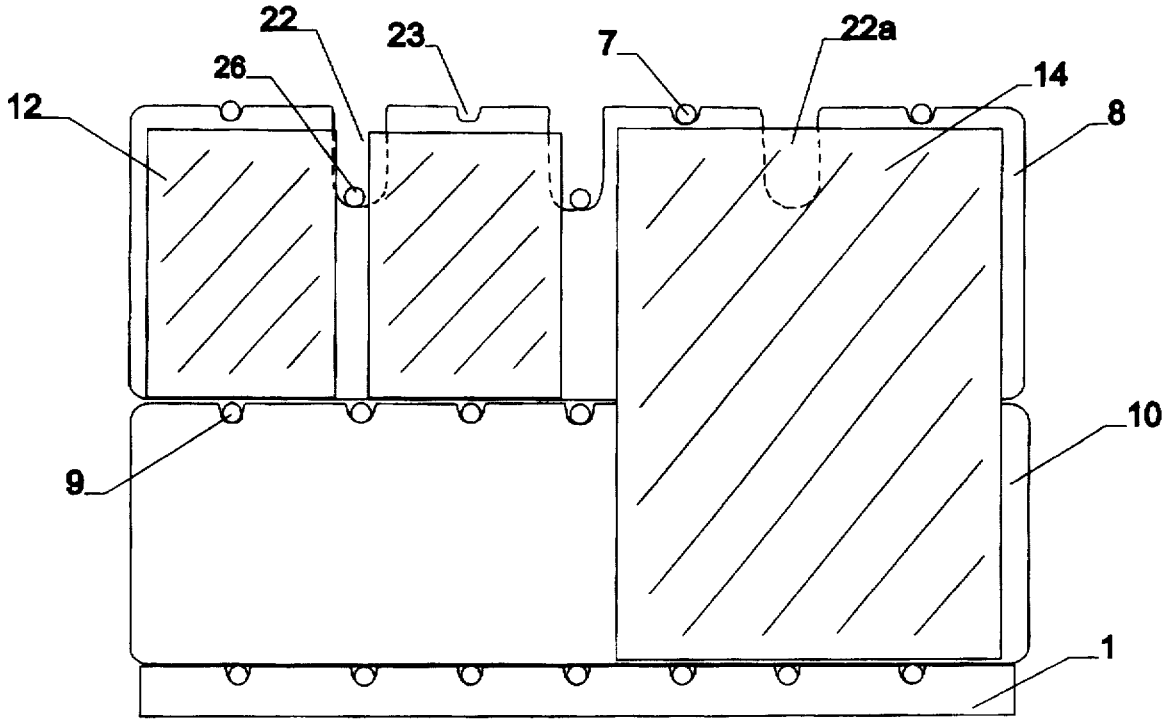
FIG. 6 shows one set of dividers only with an example of two sizes of material to be washed, and how the divider design accommodates both sizes.

Top hold down rods 7 are placed in the shallow receiving slots FIG. 6, 23 if material being washed begins to float.

FIG. 3 shows the washer from the end with the end removed. Large format material 14 to be washed is placed in the print chamber FIG. 4, 24 and inserted until the bottom of the material rests on the top of the bottom dividers 1. Center optional rods 9 are placed across one-half of the washer so that small format material 12 and 13 can be washed at the top of the washer. Some of the top dividers 8 have been removed to make room for film on reels 13 to be washed. Top hold down rods 7 are placed in the receiving slots of the top dividers to keep material being washed from floating above the water line.

FIG. 4 shows a detail of the inlet chamber. Holes 15, 16 and 17 of 1/16 inch diameter are drilled in the slotted side of the inlet chamber. These holes are positioned to direct the flow of water inside the washer. The diameter of the holes changes slightly with the size of the washer to maintain a proper speed of water with a calculated flow rate. The top holes 15 are placed in the center of each print chamber 24 drilled perpendicular to the surface of the inlet chamber. The middle holes 16 are off-set to one side of each print chamber 24 to keep small format prints from sticking to the dividers. The edge of a small format print 12 is kept away from the divider by placing the belly of the print to the side of the chamber 24 that has the middle hole 16. Large format material, the edge of which is illustrated by the line 14, is held away from the dividers by holes 17 drilled on each side of the print chamber.

Figure 5:
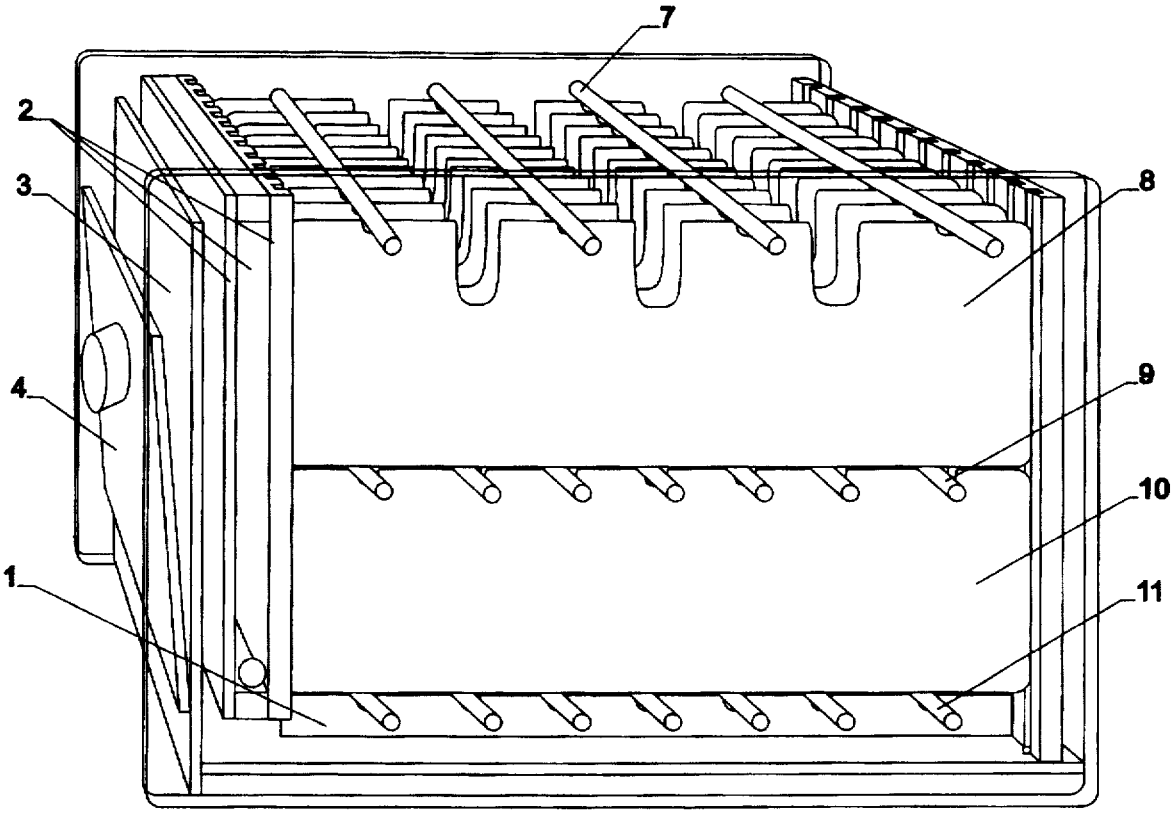
FIG. 5 shows the washer and all components in one of the possible configurations.

FIG. 5 shows all of the washer components in place, including the optional center rods for small format.

FIG. 6 shows just the dividers, configured as they would be in the washer. Bottom dividers 1 are 1 inch tall with receiving grooves evenly spaced from one end to the other. The receiving grooves hold the bottom rods 11 that suspend the large format material off the bottom of the washer. Bottom dividers 1 are permanently attached to the bottom of the washer to add structural support for the bottom of the washer. Middle dividers 10 also have the same series of receiving grooves as the bottom dividers. The receiving grooves in the middle dividers 10 are to hold the middle optional rods 9 for keeping small format material 12 on the top of the washer. Top dividers 8 have some shallow receiving grooves as in the middle and bottom dividers. The shallow grooves in the top dividers are for hold down rods that keep material from floating above the water line. Top dividers 8 also have deeper and wider grooves. The deep wide grooves are 1 inch wide and 1 ½ inches deep. These deep grooves serve two purposes; first, they provide space for the user to get their finger and thumb between the dividers to easily retrieve material, and second, they receive a hold down rod 24 at a level low enough to keep two smaller format prints from drifting together during the wash.

Figure 7:
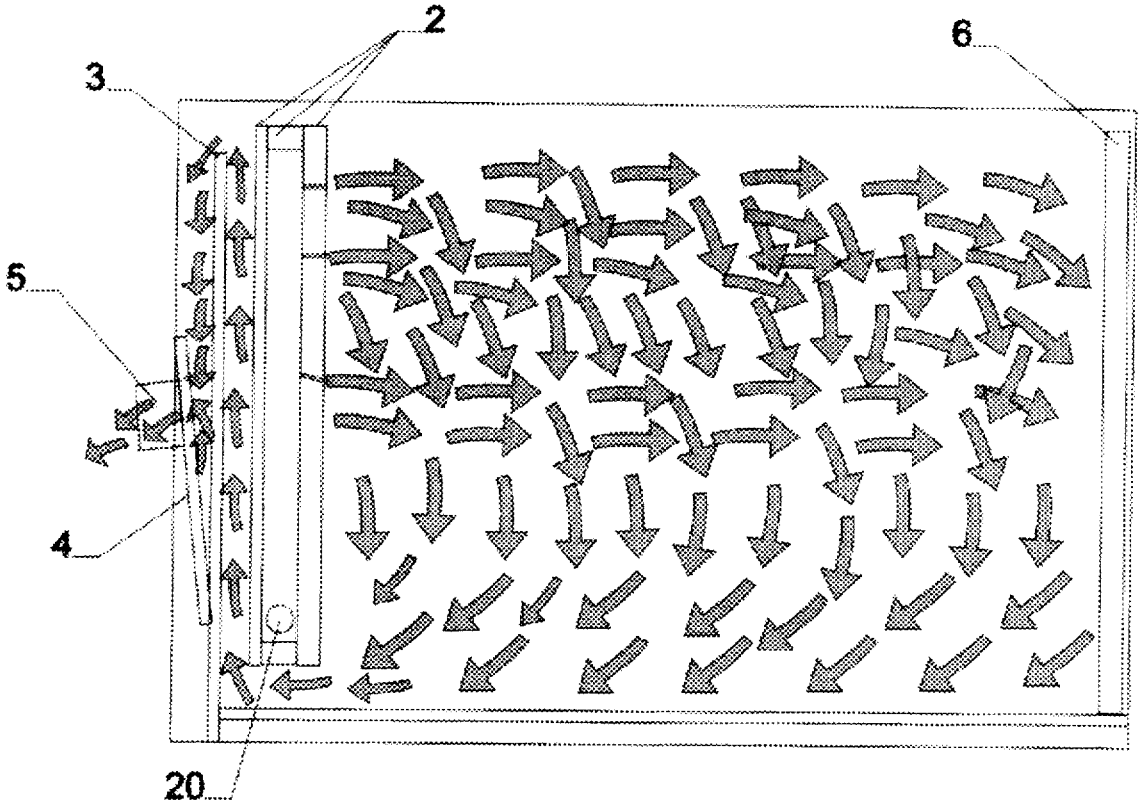
FIG. 7 shows how water is introduced to the print chambers, and exits under, and completely outside of the print chambers.

FIG. 7 shows the washer without dividers to illustrate how water flows through the washer system. Water is introduced to the inlet manifold 2 through a hose (not shown) attached to the incoming water fixture 20. From the inlet manifold 2 water is injected into each print chamber FIG. 4, 24 through the holes in the inlet manifold FIG. 4, 15, 16, and 17. Water and chemical exits the washer from below the material being washed, passes under the inlet chamber 2, up and over the overflow panel 3, into the discharge catch panel 4 where it is carried away to a sink or drain by a hose (not shown) attached to the fixture for discharge catch panel 5.

From the description above, a number of advantages of my multi level print washer become evident:

(a) By separating each divider into levels the user can easily change the configuration of the washer to handle a variety of material sizes, keeping all sizes at the top of the washer.

(b) By using round rods to hold material at the chosen level, the surface that the material rests on is virtually eliminated, leaving no possibility for trapping chemical in corners or edges of the material being washed.

(c) By using shorter rods at a higher level in one side of the washer the user can wash both large material and small material at the same time.

(d) By suspending the inlet chamber off the bottom of the washer water and heavy chemical can exit the washer from below and outside the print chambers.

OPERATIONS—FIGS. 2, 3, 5, 6

To set the washer for conventional use, that is to wash the size of material that will fit one piece per chamber and reach all outer dimensions of the chamber, the user inserts the bottom rods FIG. 2, 11 into the slots in the bottom rod holders FIG. 2, 1. The bottom rods keep full size material off the bottom of the washer. Bottom dividers FIG. 2, 10 are then inserted, one per chamber, into the slots FIG. 5, 25 on both ends of the washer. Top dividers FIG. 2, 8 are inserted one per chamber, into the slots FIG. 5 ,25 and full size material is then inserted into each print chamber FIG. 3, 24.

To set the washer for small format material the user removes the top dividers FIG. 5, 8 by sliding them out of the grooves. Center optional rods FIG. 5, 9 are then placed in the slots across the top, and perpendicular to the bottom dividers FIG. 5, 10. Top dividers are then replaced in the slots 5, 25 and small material can be washed at the top of the washer FIG. 6, 12. Drift rods FIG. 6, 26 are then placed perpendicular to the top dividers, and to the bottom of the deep slot in top dividers FIG. 6, 22 to keep small material in the same print chamber from drifting together.

To configure the washer for film on reels FIG. 3, 13 the user inserts central optional rods as described in the paragraph above and simply removes as many top dividers as necessary to accommodate the film to be washed.

SUMMARY, RAMIFICATIONS, AND SCOPE

Accordingly, the reader will see that:

The multi level dividers allow the user to wash any size material at the same time, while keeping the small material at the top of the washer.

The use of round rod at each level effectively eliminates any surface that the material rests on. This suspends the material in water removing the possibility of residual chemical becoming trapped in a corner or collecting along the bottom of the material to be washed.

Raising the inlet chamber off the bottom of the washer provides an outlet for water and heavy chemical below and outside of the print chamber.

The use of deep slots in the top dividers provides the user with space for their thumb and finger to easily retrieve material from print chambers as well as a receptacle for rods to keep small material in the same print chamber from drifting together.

Although the description above contains many specificities, these should not be construed as limiting the scope of the invention but as merely providing illustrations of some of the presently preferred embodiments of this invention. For example, there can be any number of divider levels to accommodate different size material. Deep and shallow grooves in dividers can be placed at any predetermined distance along the length of the divider, etc.

Thus the scope of the invention should be determined by the appended claims and their legal equivalents, rather than by the examples given.

I claim:

1. An improved divider for use in a photographic print washer containing vertical chambers for holding photographic material to be washed clean of chemical residue, the vertical chambers being separated by a divider, the improvement comprising:

a bottom section defining a lower portion of the divider; and a top section defining an upper portion of the divider, wherein the top section is configured to be selectively associated with the bottom section.

2. The improved divider of claim 1, further comprising:

a middle section defining an intermediate portion of the divider, wherein the middle section is configured for selective association with the bottom and top sections such that the divider can be configured to have a varying height corresponding to different heights of said photographic material to be washed.

3. The improved divider of claim 1, wherein the bottom and top sections each include a top edge, the improvement further comprising:

a series of slots at predetermined intervals along the top edge of said bottom and top sections; and rods for supporting said bottom and top sections, wherein each of the rods is configured to be placed within one of the series of slots perpendicular to said bottom and top sections.

4. The improved divider of claim 3, wherein each of the series of slots in the top section of the divider extend from the top edge to a first depth, and further wherein the top section includes a finger slot extending from the top edge to a second depth greater than the first depth, the second depth being sufficient to allow an upper edge of said photographic material to be washed extend within a void created by said finger slot, and further wherein said finger slot is configured to be wide enough to receive a finger of a user, whereby making it easier to retrieve said photographic material to be washed.

5. The improved divider of claim 4, further including a plurality of finger slots spaced along a length of said top section at intervals that correspond to a length of said photographic material to be washed and are sized such that said rods can be placed in said plurality of finger slots to keep said photographic material to be washed from drifting together.

6. In a photographic print washer including a basin containing vertical chambers for holding photographic material to be washed clean of chemical residue, the vertical chambers being separated by a selectively positioned divider, the improvement comprising:

rods for receiving a lower edge of said photographic material; and bottom rod holders attached to a bottom of said basin, wherein the bottom rod holders are configured to selectively receive and maintain said rods.

7. The photographic print washer of claim 6, wherein each of the bottom rod holders includes a series of slots at predetermined intervals along a top of said bottom rod holders, each of the series of slots being sized to receive one of the rods and each of the bottom rod holders are of a predetermined height that produces a space below said rods so that water and said chemical to be removed can flow clearly away from said photographic material to be washed.

8. In a photographic print washer including a basin containing a fluid inlet,vertical chambers for holding photographic material to be washed clean of chemical residue and a fluid outlet, the vertical chambers being separated by a selectively positioned divider, he improvement comprising:

a bottom spacer for supporting the photographic material within the vertical chambers above a bottom of the basin; and a guide panel positioned between the fluid outlet and the vertical chambers, the guide panel configured such that water and said chemical residue is directed under said bottom spacer and exits said print washer outside of said vertical chambers.

9. The photographic print washer of claim 8, wherein the guide panel defines a portion of a channel through which water and chemical residue is directed to the fluid outlet.

10. The photographic print washer of claim 8, further including:

an overflow panel positioned between the guide panel and the fluid outlet, the overflow panel including a top flow portion.

11. The photographic print washer of claim 10, wherein the top flow portion of the overflow panel defines a fluid level limit within the basin.

12. The photographic print washer of claim 11, wherein the fluid outlet is disposed on a side of the basin at a level lower than the top flow portion of the overflow panel.

13. The photographic print washer of claim 11, wherein the top flow portion of the overflow panel is defined by an upper edge of the overflow panel.

14. The photographic print washer of claim 8, further including:

a material catch disposed between the fluid outlet and the guide panel for collecting the chemical residue.

15. The photographic print washer of claim 14, wherein the fluid outlet is disposed on an exit side of the basin, and further wherein the material catch is a plate having a first edge attached to the exit side of the basin.

16. The photographic print washer of claim 15, wherein the first edge of the plate is positioned below the fluid outlet.

17. The photographic print washer of claim 6, wherein each of the bottom rod holders are configured to selectively receive at least three rods.

18. The photographic print washer of claim 6, wherein each of the rods is cylindrical, having a circular cross section.

* * * * *